United States Patent [19]

Ross et al.

[11] Patent Number: 4,953,617

[45] Date of Patent: Sep. 4, 1990

[54] APPARATUS FOR SETTING AND RETRIEVING A BRIDGE PLUG FROM A SUBTERRANEAN WELL

[75] Inventors: Richard J. Ross; Jim H. Roddy, both of Houston, Tex.

[73] Assignee: Baker Hughes Incorporated, Houston, Tex.

[21] Appl. No.: 423,889

[22] Filed: Oct. 19, 1989

[51] Int. Cl.[5] ..... E21B 33/127; E21B 34/06

[52] U.S. Cl. ..... 166/187; 166/192; 166/319; 166/325; 166/332

[58] Field of Search ..... 166/192, 187, 179, 194, 166/120, 135, 319, 324, 325, 332

[56] References Cited

U.S. PATENT DOCUMENTS

| | | | |
|---|---|---|---|
| 2,839,142 | 6/1958 | Huber | 166/192 X |
| 2,953,206 | 9/1960 | Brown | 166/332 X |
| 3,102,594 | 9/1963 | Crowe | 166/192 X |
| 3,250,331 | 5/1966 | Boyle | 166/135 X |
| 3,314,479 | 4/1967 | McCullough et al. | 166/192 X |
| 3,434,538 | 3/1969 | Kilgore et al. | 166/135 X |
| 3,454,089 | 7/1969 | Brown | 166/332 X |
| 4,646,829 | 3/1987 | Barrington | 166/192 X |
| 4,648,448 | 3/1987 | Sanford et al. | 166/187 |
| 4,869,325 | 9/1989 | Halbardier | 166/187 X |

FOREIGN PATENT DOCUMENTS

| | | | |
|---|---|---|---|
| 599047 | 3/1978 | U.S.S.R. | 166/120 |
| 926238 | 5/1982 | U.S.S.R. | 166/120 |

*Primary Examiner*—Hoang C. Dang

*Attorney, Agent, or Firm*—Hubbard, Thurman, Turner, Tucker

[57] ABSTRACT

An apparatus for setting and retrieving a bridge plug of the type which may be passed through a small diameter tubing, and may be sealed against a relatively large diameter casing by pressured fluid to inflate an elastomeric packing element carried by the bridge plug. The running tool is engagable with a valve housing by a J-slot connection and an axially shiftable, pressure balanced valve plug cooperates with the valve housing to open or close the fluid passageway therethrough extending to the inflatable elastomeric packing element. Upward movement of the running tool followed by left hand rotation effects the closing movement of the valve plug and the disengagement of the running tool. Downward movement of the running tool, while engaged with the valve housing, effects an opening of the plug valve.

14 Claims, 5 Drawing Sheets

APPARATUS FOR SETTING AND RETRIEVING A BRIDGE PLUG FROM A SUBTERRANEAN WELL

BACKGROUND OF THE INVENTION

1. FIELD OF THE INVENTION

The present invention relates to a bridge plug employing an inflatable elastomeric packing element to permit the bridge plug to be passed into a subterranean well bore through relatively small diameter production tubing. During run-in and setting of the bridge plug, a tubular mandrel carried by the running tool engages a pressure balanced, axially shiftable valve plug to maintain the valve plug in an open position for fluid to flow downwardly into the inflatable elastomeric element. After inflation, the running tool is disengaged from the bridge plug and such disengagement effects a closing of the axially shiftable plug valve.

2. DESCRIPTION OF THE PRIOR ART

Those skilled in the art relating to remedial operations associated with drilling, production and completion of subterranean oil and gas wells have long utilized threaded or coupled remedial tubing inserted through production tubing, for pumping pressured fluid from the surface to a bridge plug having an inflatable elastomeric packing element. More recently, continuous coiled remedial tubing has frequently replaced threaded or coupled tubing to pass fluid to the inflatable elastomeric element, since coiled tubing may be more rapidly inserted into the well and may be easily passed through production tubing and related downhole equipment because its diameter is consistently the same size.

Typical remedial coiled tubing apparatus is described in the 1973 Composite Catalogue of Oil Field Equipment and Services, at page 662, and manufactured by Bowen Tools, Inc. of Houston, Tex. Apparatus related to this coiled tubing technique is more particularly described in U.S. Pat. Nos. 3,182,877 and 3,614,019. More recent advances, such as those disclosed in U.S. Pat. No. #4,349,204, enable the inflatable bridge plug to pass through a small diameter production tubing, effect seal with a larger diameter casing, and then be retrievable to the surface through the small diameter tubing.

When it is desired to insert an inflatable bridge plug into a subterranean well by passage through a relatively small diameter production tubing, a problem arises in maintaining circulation between the tubing bore and the annulus during run-in. This necessarily requires that a valve plug of some type be incorporated in the bore of the bridge plug to permit fluid passage therethrough during run-in, but then being shiftable to a closed position after the setting of the inflatable bridge plug is accomplished. This creates a new problem in that the valve plug is subjected to the pressure of the well fluids surrounding the bridge plug and hence is very difficult to re-open for retrieval unless such pressure is substantially equalized.

A further problem arises when coiled tubing is utilized to run-in the inflatable bridge plug. As is well known, the amount of compressive force exertable by coiled tubing is very limited, due to its tendency to buckle. It is therefore essential that the valve plug be shiftable to an open position by a setdown weight which does not require any significant compression of the coiled tubing.

SUMMARY OF THE INVENTION

The invention provides a unique bridge plug and running tool for a bridge plug having an inflatable packing element which overcomes the aforementioned disadvantages of the prior art apparatus. At the lower end of the body of the bridge plug, an inflatable elastomeric packing element is provided in conventional fashion. Such packing element is inflatable by fluid pressure developed within the bore of the tubular body.

An upstanding tubular valve housing is secured to the upper end of the aforementioned bridge plug body and defines a middle seal bore and an upper and lower seal bore of substantially smaller diameter, thus creating a downwardly facing shoulder and an upwardly facing shoulder between such seal bores. A valve plug having a closed upper end is mounted in the bore of the valve housing and has a lower external seal cooperable with the lower seal bore and an upper external seal cooperable with the upper seal bore and a middle seal. The valve plug is normally biased to a closed upward position determined by the downwardly facing shoulder, by the action of a compressed spring.

One or more radial ports are provided in the tubular portion of the valve plug located intermediate the aforementioned middle and upper external sealing elements. Thus, when the valve plug is axially displaced downwardly from its closed position, a path for fluid flow through the bore of the valve housing is established, permitting fluid to pass downwardly to the inflatable elastomeric element of the bridge plug.

The running tool associated with the bridge plug has a downwardly open J-slot within which a projecting lug formed on the top end of the valve housing is cooperable. In the run-in position of the running tool, a tubular mandrel disposed within the bore of the tubular running tool projects downwardly within the upper end of the valve housing and engages the top closed end of the valve plug to push the valve plug to an open position permitting fluid flow through the valve housing. Such fluid flow can be utilized to effect the expansion of the inflatable elastomeric packing elements in conventional fashion. After expansion and setting of the elastomeric packing elements, it is generally desired to effect the disengagement and removal of the running tool from the bridge plug. This is accomplished by an upward movement of the running tool which permits the valve plug to move upwardly to its closed position, thus preventing any further fluid flow down through the bore of the bridge plug. To disconnect the running tool from the bridge plug, the tubing is set down, thus opening the valve. Thereafter, the tubing is picked up and turned to the left simultaneously and the valve is closed as the running tool is raised.

After withdrawal of the running tool, the valve plug is subjected to fluid pressure forces from the well fluids surrounding the bridge plug. A port is provided in the valve housing below the middle seal element on the valve plug and this port effects a substantial equalization of the fluid pressure forces acting on the valve plug.

Accordingly, when it is desired to retrieve the bridge plug, the running tool is lowered into the well and rotated a sufficient degree to effect the engagement of the J-slot with the J-pin on the upper end of the valve housing. A small amount of setdown weight will produce a downward movement of the hollow mandrel carried by the running tool sufficient to displace the valve plug downwardly to its open position since the compressed spring is the only effective force acting on the valve plug. A fluid passage is thus reopened from the coiled tubing downwardly through the bridge plug to the well bore below the plug. The inflatable elastomeric elements are then deflated by applying upward force or rotation to the packer mandrel. Upon deflation of the elastomeric packing elements, the entire bridge plug may be retrieved from the well by the running tool.

A further feature of the running tool embodying this invention is the mounting thereon of a wash-over sleeve which projects downwardly from the running tool in surrounding relationship to the upstanding portions of the bridge plug, including the valve housing. Such wash-over sleeve permits sand or debris that might have collected around the top of the valve housing to be washed away by fluid pumped down through the hollow mandrel prior to the running tool being fully engaged with the valve housing. A further feature of the invention is the incorporation of means for rotating the wash-over sleeve in a right hand direction to assist in the loosening of debris around the upstanding valve housing, without effecting a relative rotation of the sleeve carrying the J-slot. This is accomplished by a ratcheting spring connection between the J-slot sleeve and the body of the running tool which locks the J-slot sleeve to such body for axial co-movement and co-rotational movements to the right, but permits relative rotation of the running tool with respect to the J-slot sleeve when the running tool is rotated to the left.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
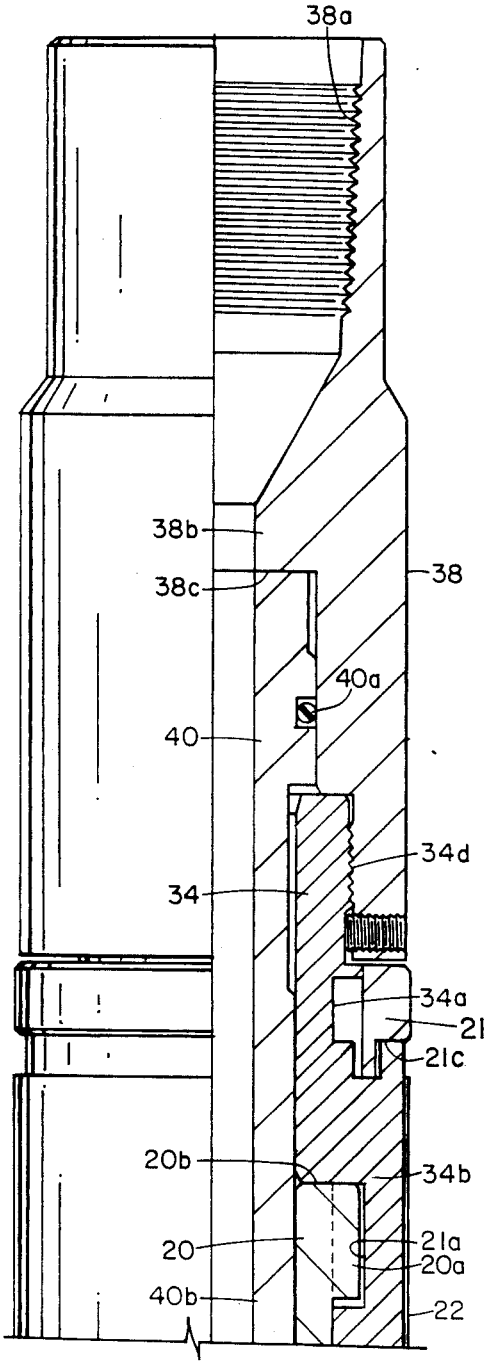
FIGS. 1A, 1B, 1C and 1D collectively represent a vertical, quarter sectional view of an inflatable bridge plug and running tool embodying this invention, with the elements thereof shown in their run-in position.
Figure 2A:
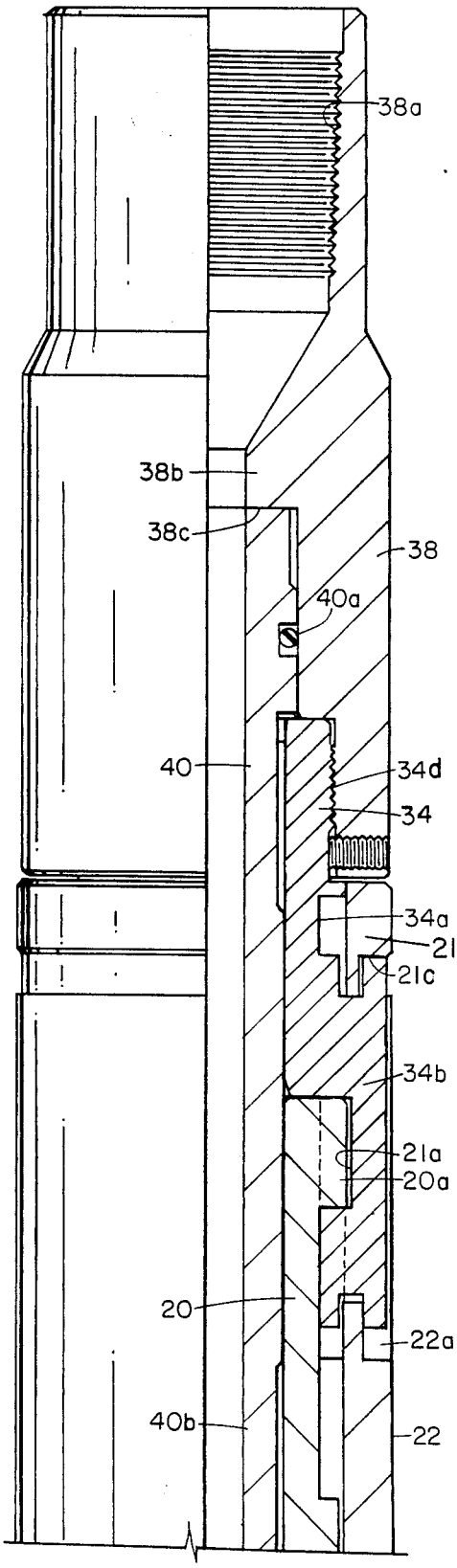
FIGS. 2A, 2B, 2C and 2D respectively correspond to FIGS. 1A, 1B . . . 1D and illustrate the components of the inflatable bridge plug and running tool into positions assumed just prior to the release of the running tool from the bridge plug.
Figure 1B:
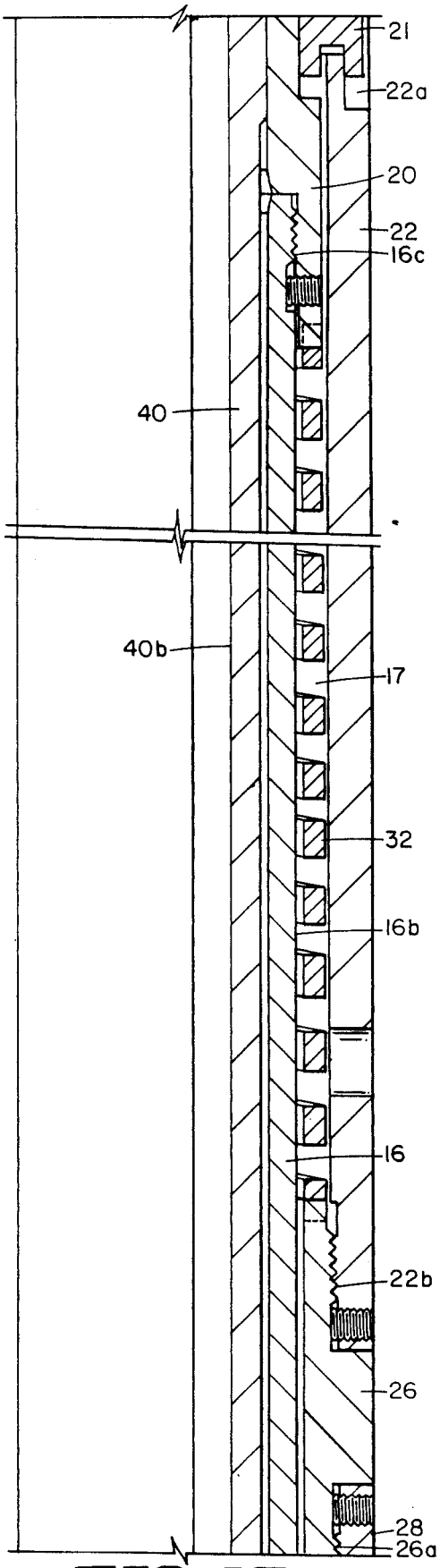
Figure 2B:
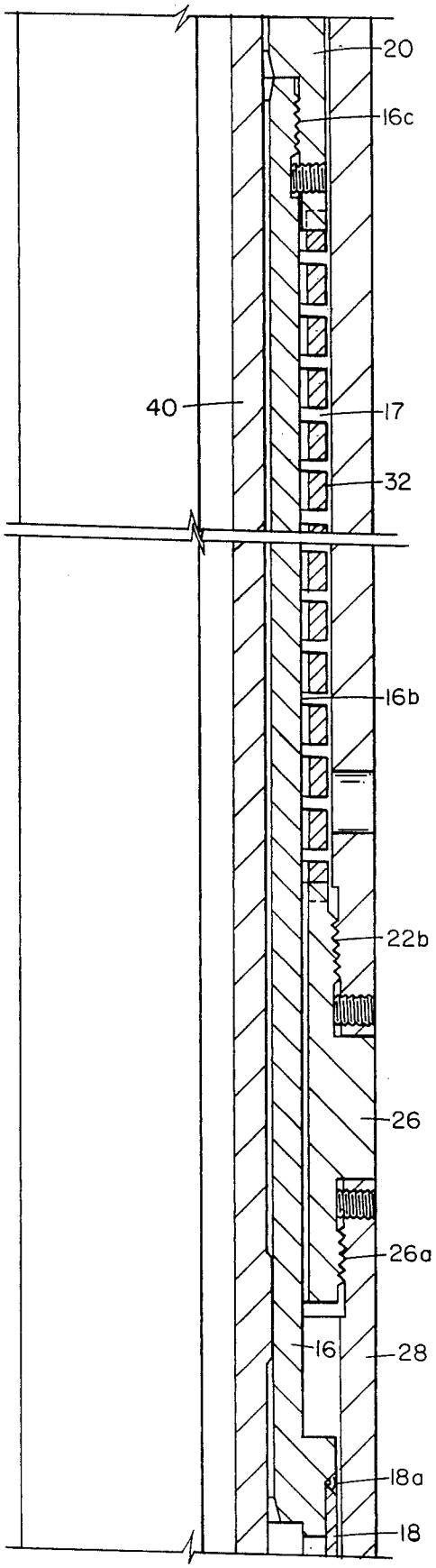
Figure 1C:
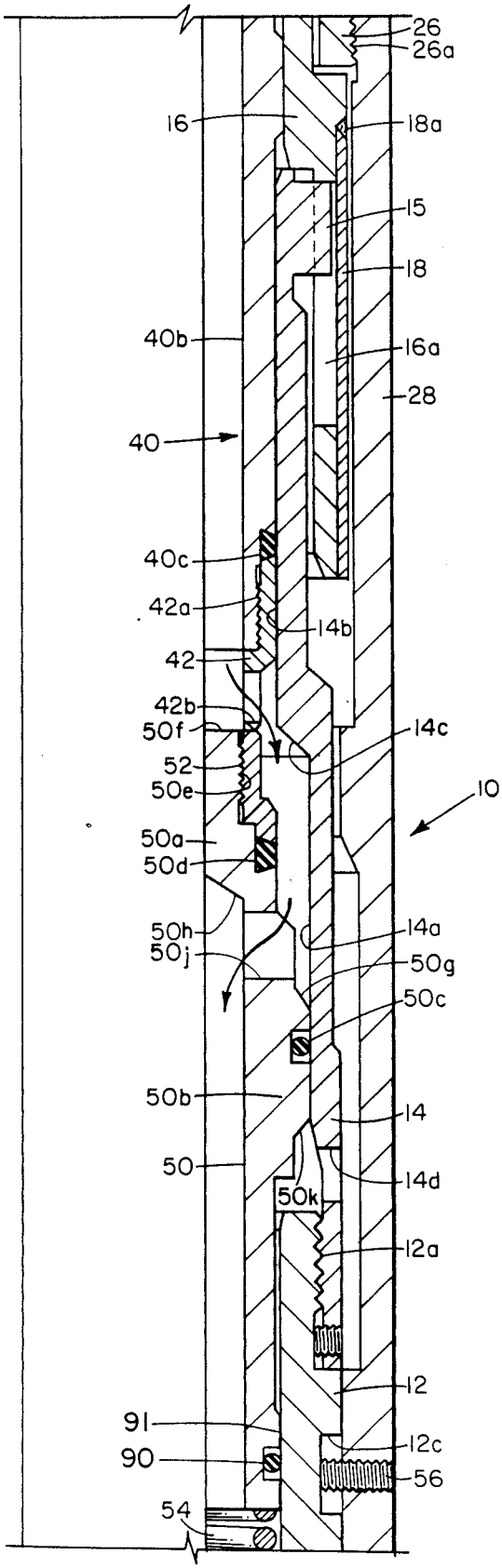
Figure 1D:
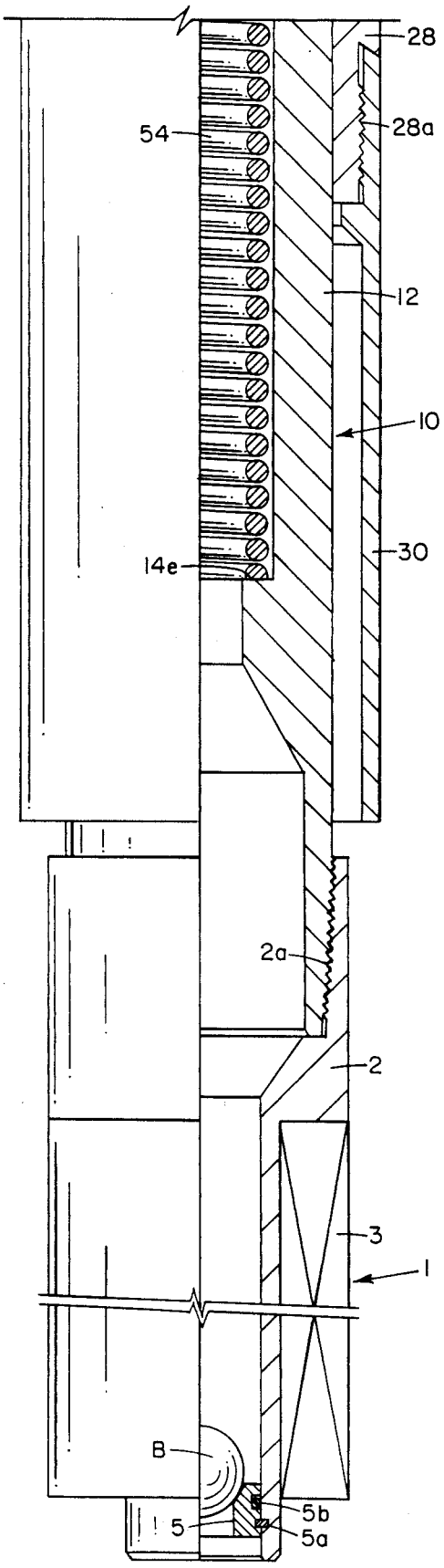
Figure 2D:
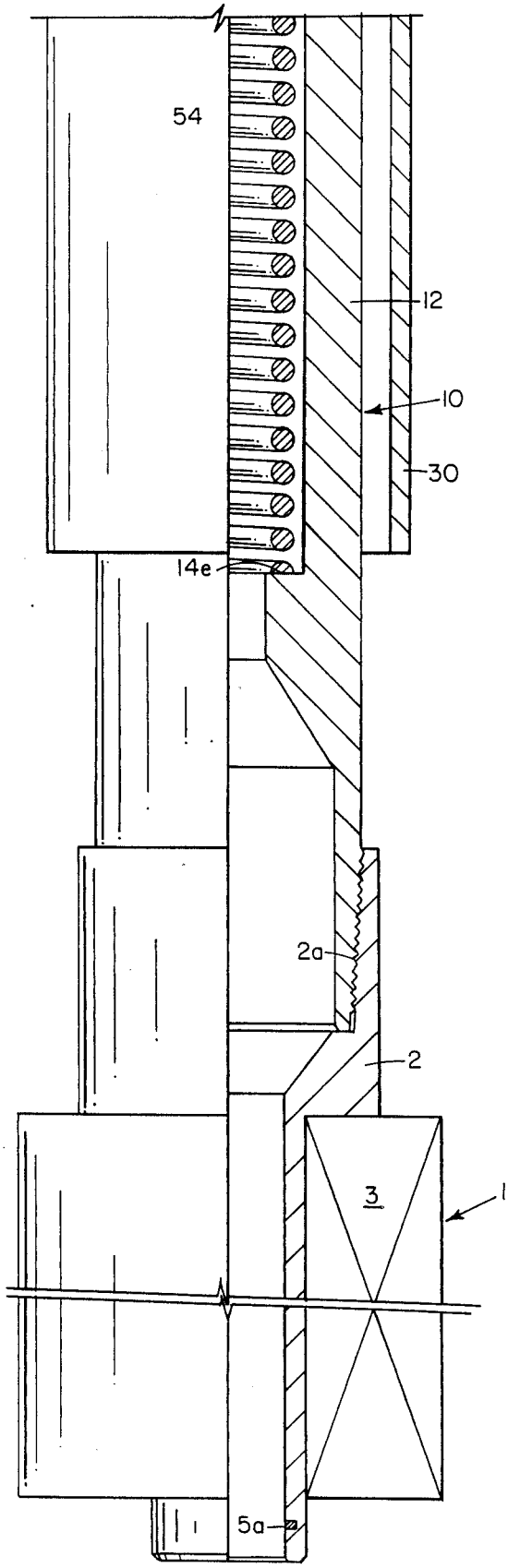
Figure 3:
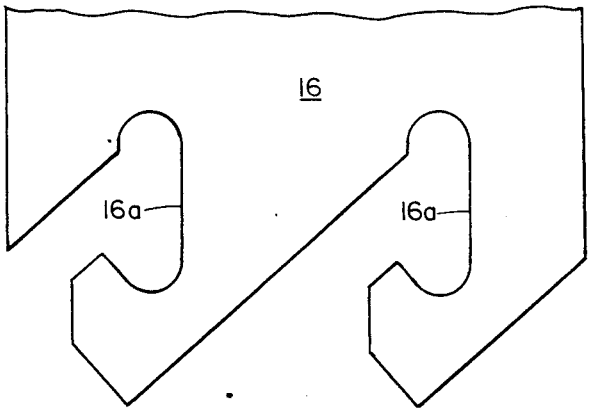
FIG. 3 is a developed view of the J-slot incorporated in the running tool.

Referring first to FIG. 1D, which schematically shows the bottom of the apparatus, there is shown a conventional inflatable packer 1 having a body portion 2 around which an inflatable elastomeric element 3 is mounted in conventional fashion. The upper end of body portion 2 is secured by internal threads 2*a* to the bottom of an upstanding valve housing 10, and more specifically to a lower sleeve portion 12 of valve housing 10. Those skilled in the art will understand that the elastomeric inflatable packing element 3 is inflated through conventional valving members (not shown) by fluid pressure produced within the bore of the inflatable packing element by pressuring against a ball B on a shearable valve seat 5 which is secured to the lower end of the body 2 by a shear ring 5*a* and sealed by an O-ring 5*b*. All of this construction is conventional and well known in the art, hence further description thereof is deemed unnecessary.

Proceeding upwardly on the tool, and referring particularly to FIGS. 1C and 1D, the valve housing 10 includes the aforementioned bottom sleeve portion 12 which is secured at its upper end by external threads 12*a* to the bottom end of a lug nipple 14. Lug nipple 14 is a tubular element defining at its lower end a lower seal bore 14*a* and at its upper end an upper seal bore 14*b*, of substantially smaller diameter than lower seal bore 14*a*. Thus a downwardly facing inclined shoulder 14*c* is defined at the juncture of the upper and lower seal bores. One or more radial ports 14*d* are provided in the lower end of the lug nipple 14 for a purpose to be hereinafter described.

The top end of lug nipple 14 is provided with a pair of diametrically spaced, outwardly projecting J-lugs 15. Such lugs cooperate with a pair of downwardly opening J-slots 16*a* provided in the lower extremities of a J-slot sleeve 16. For convenience in machining operations, the lower slot defining portions of the J-slot sleeve 16 are enclosed within a tube 18 which is rigidly secured to the J-slot sleeve 16 by a weld 18*a*.

Above the weld 18*a*, the J-slot sleeve 16 is reduced in diameter to form an upwardly extending spring guide portion 16*b* (FIG. 1B), which is secured to the lower end of a torque sub 20 by threads 16*c*. Torque sub 20 is provided at its upper end with one or more peripherally spaced, radial lugs 20*a* for a purpose to be hereinafter described.

A key housing 22 (FIGS. 1A and 1B) is provided in surrounding relationship to the torque sub 20 and defines a plurality of peripherally spaced, axially extending slots 22*a* for respectively receiving keys 21 which also cooperate with the torque sub 20 by having a recess 21*a* for receiving lugs 20*a*. The key housing 22 extends downwardly in radially spaced relationship to the spring guide tube 16*b* and is connected by internal threads 22*b* at its lower end to a connecting sub 26. Connecting sub 26 has external threads 26*a* at its lower end which are connected to a J-slot housing 28 which snugly surrounds the J-slot cover tube 18 and extends downwardly to a position below the lug nipple 14 where it is provided with external threads 28*a* (FIG. 1D) for connection to a washover tube 30 which extends downwardly to a point adjacent the bottom end of upstanding valve housing 10.

Figure 4:
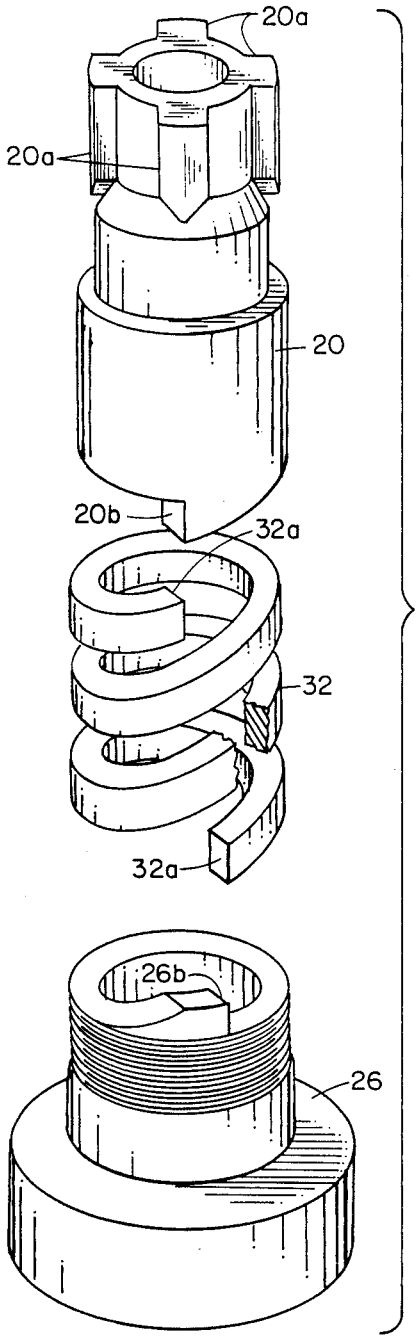
FIG. 4 is an exploded perspective view of the spring ratchet clutch element employed in the running tool.

An annular space 17 is defined between the exterior surface of the spring guide tube 16*b* and the internal surface of the key housing 22. A rectangular ratchet spring 32 is mounted in the annular recess 17 and has squared off ends 32*a* formed on both its top and bottom (FIG. 4). These squared off ends 32*a* respectively cooperate with a depending ratchet tooth 20*b* formed on the lower end of the torque sub 20 and an upwardly projecting ratchet tooth 26*b* formed on the upwardly facing end of the connecting sub 26. The configuration of the ratchet teeth 20*b* and 26*b* is such as to permit free rotation of key housing 22 relative to the J-slot sleeve 16 when the key housing is rotated to the right, but to produce co-rotation of the J-slot sleeve 16 when the key housing 22 is rotated to the left. The advantages of this arrangement will be hereinafter described.

Key housing 22 includes a key actuating sleeve 34 portion which has a plurality of peripherally spaced slots 34*a* receiving the upper portion of keys 21 and an outwardly projecting shoulder 34*b* disposed intermediate the top surface 20b of the torque sub 20 and a downwardly facing shoulder 21c provided on the key 21.

The top portion of the key actuating sleeve portion 34 is provided with external threads 34d by which it is secured to a top sub 38 having internal threads 38a for connection to remedial tubing such as coiled tubing or a small diameter tubing string.

Top sub 38 is provided with an inwardly enlarged portion 38b which defines a downwardly facing shoulder 38c. A hollow mandrel 40 is then inserted in the bore 38d of top sub 38 and sealed thereto by an O-ring 40a. A reduced diameter portion 40b of mandrel 40 extends downwardly through all of the aforedescribed tubular components and extends a substantial distance within the upper seal bore 14b of the lug nipple sleeve 14. An external annular seal 40c is retained in position near the bottom of mandrel 40 by a seal retaining ring 42 and sealably engages the upper seal bore 14b. Threads 42a secure retaining ring 42 to mandrel 40. One or more radial ports 42b are provided in retaining ring 42.

Within the bore of the lug nipple sleeve 14, a tubular valve plug or poppet 50 having a closed upper end 50a is slidably and sealably mounted. Valve plug 50 has an enlarged medial portion 50b mounting an O-ring 50c which sealably engages the lower seal bore 14a of the lug nipple housing 14. The top closed end 50a of the valve plug 50 mounts an annular seal 50d which is secured in position by a retaining ring 52 threadably secured by external threads 50e provided on the valve plug 50. The annular seal 50d sealingly engages the upper seal bore surface 14c of lug nipple 14 when the valve plug 14 is shifted upwardly to a closed position.

The covering of the valve plug 50 has a reduced diameter for mounting of an O-ring seal 90 which engages seal bore 91 in the bottom sleeve 12. Seal 90 and seal bore 91 together with seal 50c and seal bore 14a define the balance area for pressure above the tool to "push" the valve upwardly to the closed position. The area between 90-91 and 50c-14a must be substantially the same as the area across the seal 50d, in order for the valve to be balanced.

It will be appreciated that when the running tool is assembled with the bridge plug, the shear screws 56 will hold the running tool securely downwardly which, in turn, holds the valve open to allow the tubing to fill. If these screws are sheared it is possible that fluid could be pumped through the valve with the running tool attached. It will be noted that the valve is only pressure balanced when the running tool is disconnected or the tubing pressure above the tool and the annulus pressure above the tool are equal.

Intermediate the valve plug seals 50c and 50d, one or more ports 50j are provided. Thus, when the valve plug 50 is moved downwardly to its run-in, open position as shown in FIG. 1C, through the abutting contact of the lower end of the hollow mandrel 40, a fluid passage is defined through the entire valve housing 10 as indicated by the arrows.

Figure 2C:
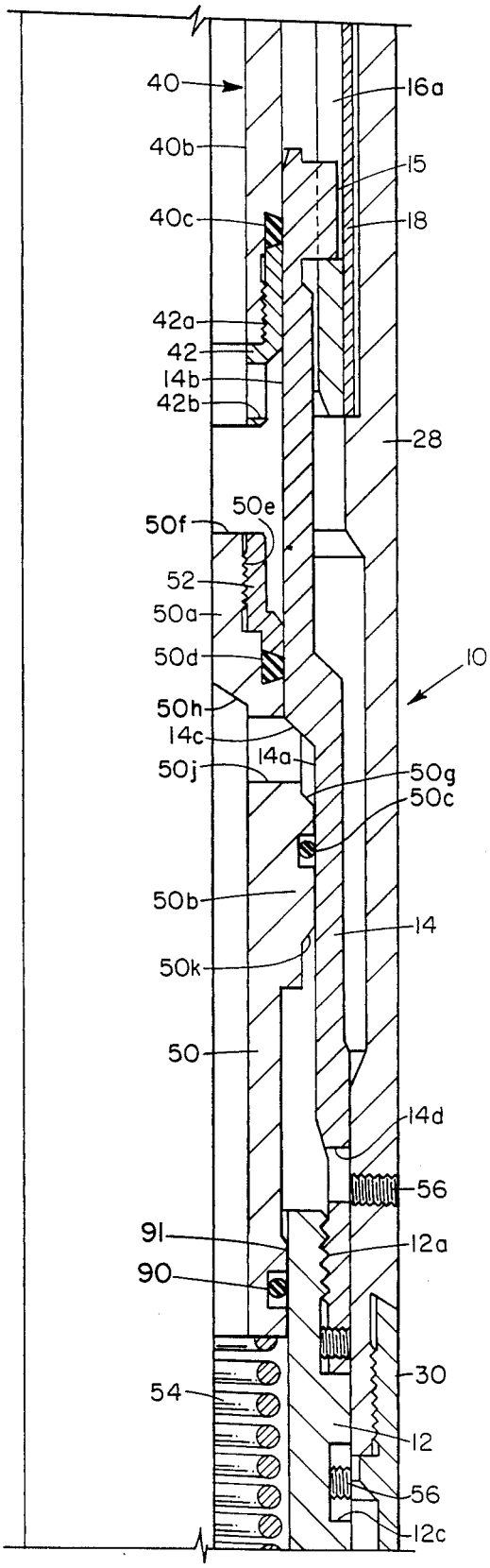

A spring 54 is mounted between the bottom end of valve plug 50 and an internally projecting shoulder 14e provided on the lug nipple housing 14 and such spring urges the valve plug 50 upwardly to its closed position as illustrated in FIG. 2C. Valve plug 50 can only assume this closed position when the remedial tubing to which the entire valving structure is attached is manipulated to raise the mandrel 40.

Lastly, one or more shear pins 56 are provided which traverse the lower end of the J-slot housing 28 and engage an annular groove 12c provided in the lower housing element 12. Shear screws 56 thus maintain all of the aforedescribed components in their run-in position illustrated in FIGS. 1A-1D.

The operation of the aforedescribed apparatus will be readily apparent to those skilled in the art. With the components assembled in their run-in position, the deflated elastomeric packing element 3 and the attached valving apparatus is lowered through small diameter existing tubing into the subterranean well until the elastomeric packing element passes through the existing tubing and reaches a position where a seal with the surrounding well casing is desired. Fluid pressure can then be supplied from the surface and, due to the fact that a ball B or plug is seated on the shearable valve seat 5, the fluid pressure can be built up to a level sufficient to effect the expansion of the elastomeric packing element 3 into sealing engagement with the casing wall. A check valve (not shown) employed in the fluid conduit supplying the inflatable elastomeric element 3 closes to trap the inflating pressure within the elastomeric element, as is common.

The fluid pressure is then increased to a level sufficient to effect the shearing of the valve seat 5 which removes the ball B or plug from the bore of the apparatus and permits the entire bore of the apparatus to be exposed to well fluids. The running tool portion of the apparatus is removed by turning the remedial tubing to the left and elevating the remedial tubing to align the J-lugs 14c with the downwardly open portions of the J-slot 16a, thus permitting the entire running tool apparatus to be removed from the well. The initial upward movement of the running tool permits the valve plug 50 to move upwardly under the bias of spring 54 and thus assume a closed position in the bore of the packing element.

It should be noted that in this position, the fluid pressures operating on the shiftable valve plug 50 are essentially balanced. Thus the upwardly facing surfaces 50f and 50g are exposed to the same pressures as the downwardly facing surfaces 50h and 50k due to the provision of the radial port 14d in the lug nipple 14.

As is well known to those skilled in the art, the operation of the well over any substantial time period will result in a collection of debris and sand around the upstanding valve housing 10. When it is desired to remove or shift the position of the inflatable bridge plug, such sand should be removed. This is conveniently accomplished by passing washing fluid downwardly through the bore of the wash-over sleeve 30 as the running tool effects its re-engagement with the upstanding valve housing 10. Additionally, the wash-over sleeve 30 may be continuously rotated to the right to assist in removal of such debris without effecting in any manner the operation of the J-slot sleeve 16 which is not secured for such rotation through the ratchet spring 32. Once the open ends of the J-slots 16aengage the J-slot lugs 14c, the bottom end of the mandrel 40 will be in abutting relationship to the valve plug 50. A very modest setdown force applied through the remedial tubing will shift the valve plug 50 downwardly since only the biasing force of the spring 54 has to be overcome because of the balancing of the well fluid pressures on the valve plug 50.

It will be appreciated that the device of the present invent on may be encompassed within a cement retainer or with a non-inflatable bridge plug or packer, or other similar well tool.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A bridge plug comprising:

a tubular body supporting an annular inflatable element;

a tubular valve housing operatively secured at its lower end to said tubular body;

said tubular valve housing defining in its medial portions three vertically spaced, internal seal bores with the middle seal bore having a larger diameter than the upper and lower seal bores, thereby defining a downwardly facing shoulder;

a generally cylindrical valve plug having a solid upper end on a tubular lower portion;

a radial port in said tubular lower portion;

a first external seal element below said radial port sealably engagable with said middle seal bore;

a second external seal element above said radial port engagable with said upper seal bore when said valve plug abuts said downwardly facing shoulder;

a third seal element below the middle seal engagement with the lower seal bore;

resilient means disposed within the lower portions of said tubular valve housing urging said valve plug into abutting engagement with said downwardly facing shoulder, thereby achieving a closed position preventing fluid flow through said valve plug into said inflatable element; and port means in said tubular valve housing below said middle seal bore for applying the pressure of surrounding well fluids to the exterior of said valve plug, thereby urging said valve plug to said closed position and balancing the well fluid forces on said valve plug when said valve is in said closed position, whereby said valve plug may be readily shifted upwardly to said closed position by said resilient means and downwardly to an open position by a small downward force exerted by a running tool and sufficient to overcome the force of said resilient means.

2. The apparatus of claim 1 further comprising:

a tubular running tool attachable to the bottom end of remedial tubing;

means for detachably connecting said tubular running tool to said valve housing; and a tubular mandrel carried in the bore of said running tool and abuttingly engagable with said valve plug to open same as said running tool is lowered to a position of engagement with said valve housing.

3. The apparatus of claim 2 wherein said means for detachably connecting said tubular running tool to said valve housing comprises:

a J-slot sleeve carried by said tubular running tool and defining a J-slot having a downwardly facing opening; and a J-pin on the upper end of said valve housing engagable with said J-slot.

4. The apparatus of claim 2 further comprising:

a wash-over sleeve carried by said tubular running tool and extending downwardly around said valve housing, whereby washing fluid may be supplied from the surface through the bore of said tubular mandrel to wash away sand from the upper portions of said valve housing prior to engagement of said tubular running tool with said valve housing.

5. The apparatus of claim 4 wherein said means for detachably connecting said running tool to said valve housing comprises:

a J-sleeve carried by said tubular running tool and defining a J-slot having a downwardly facing opening; and a J-pin on the upper end of said valve housing engagable with said J-slot.

6. The apparatus of claim 4 further comprising a shearable connection between said wash-over sleeve and said valve housing in the run-in position of such members, said shearable connection and said tubular mandrel cooperating to hold said plug valve in a downward position permitting fluid flow from the surface to said inflatable element.

7. The apparatus of claim 3 wherein said J-slot sleeve is rotatably shiftably mounted in the bore of said running tool and in surrounding relation to said tubular mandrel; and means connecting said J-slot sleeve for axial co-movement and left hand co-rotation but permitting right hand rotation of the running tool relative to the J-slot sleeve.

8. The apparatus of claim 7 wherein a ratcheting spring connects said running tool and said J-slot sleeve for left hand rotational co-movement and right hand relative rotational movement.

9. The apparatus of claim 7 wherein said J-slot is defined by a J-slot sleeve rotatably shiftably mounted in the bore of said running tool and in surrounding relation to said tubular mandrel; and means connecting said J-slot sleeve to said running tool for axial co-movement and left hand co-rotation but permitting right hand rotation of the running tool relative to the J-slot sleeve, whereby said wash-over sleeve may be rotated in the right hand direction by the running tool to loosen debris surrounding said valve housing.

10. The apparatus of claim 9 wherein a ratcheting spring connects said running tool and said J-slot sleeve for left hand rotational co-movement and right hand relative rotational movement.

11. The apparatus of claim 1 further comprising:

a tubular running tool attachable to the bottom end of remedial tubing;

means for detachably connecting said tubular running tool to said valve housing;

a tubular mandrel carried in the bore of said running tool and abuttingly engagable with said valve plug to open same as said running tool is lowered to a position of engagement with said valve housing; and whereby said tubular mandrel is selectively sealable in the valve housing to thereby permit fluid to be pumped down the tubing to act on the top of said valve plug to open said valve plug and flow therethrough.

12. The apparatus of claim 2 wherein said running tool is selectively disconnectable from the valve housing and is re-connectable without removal of said running tool from the well.

13. A bridge plug comprising:

a tubular body supporting an annular sealing device;

a tubular valve housing operatively secured at its lower end to said tubular body;

said tubular valve housing defining in its medial portions three vertically spaced, internal seal bores with the middle seal bore having a larger diameter than the upper and lower seal bores, thereby defining a downwardly facing shoulder;

a generally cylindrical valve plug having a solid upper end on a tubular lower portion;

a radial port in said tubular lower portion;

a first external seal element below said radial port sealably engagable with said middle seal bore;

a second external seal element above said radial port engagable with said upper seal bore when said valve plug abuts said downwardly facing shoulder;

a third seal element below the middle seal engagement with the lower seal bore;

resilient means disposed within the lower portions of said tubular valve housing urging said valve plug into abutting engagement with said downwardly facing shoulder, thereby achieving a closed position preventing fluid flow through said valve plug into said annular sealing device; and port means in said tubular valve housing below said middle seal bore for applying the pressure of surrounding well fluids to the exterior of said valve plug, thereby urging said valve plug to said closed position and balancing the well fluid forces on said valve plug when said valve is in said closed position, whereby said valve plug may be readily shifted upwardly to said closed position by said resilient means and downwardly to an open position by a small downward force exerted by a running tool and sufficient to overcome the force of said resilient means.

14. A well tool comprising:

a tubular body supporting an annular inflatable element;

a tubular valve housing operatively secured at its lower end to said tubular body;

said tubular valve housing defining in its medial portions three vertically spaced, internal seal bores with the middle seal bore having a larger diameter than the upper and lower seal bores, thereby defining a downwardly facing shoulder;

a generally cylindrical valve plug having a solid upper end on a tubular lower portion;

a radial port in said tubular lower portion;

a first external seal element below said radial port sealably engagable with said middle seal bore;

a second external seal element above said radial port engagable with said upper seal bore when said valve plug abuts said downwardly facing shoulder;

a third seal element below the middle seal engagement with the lower seal bore;

resilient means disposed within the lower portions of said tubular valve housing urging said valve plug into abutting engagement with said downwardly facing shoulder, thereby achieving a closed position preventing fluid flow through said valve plug into said inflatable element; and port means in said tubular valve housing below said middle seal bore for applying the pressure of surrounding well fluids to the exterior of said valve plug, thereby urging said valve plug to said closed position and balancing the well fluid forces on said valve plug when said valve is in said closed position, whereby said valve plug may be readily shifted upwardly to said closed position by said resilient means and downwardly to an open position by a small downward force exerted by a running tool and sufficient to overcome the force of said resilient means.

* * * * *